US009941621B2

(12) United States Patent
Tang

(10) Patent No.: US 9,941,621 B2
(45) Date of Patent: Apr. 10, 2018

(54) CARD EDGE CONNECTOR HAVING WIPING DUMMY CONTACT

(71) Applicant: FOXCONN INTERCONNECT TECHNOLOGY LIMITED, Grand Cayman (KY)

(72) Inventor: Wen-Jun Tang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/702,185

(22) Filed: Sep. 12, 2017

(65) Prior Publication Data

US 2018/0076560 A1 Mar. 15, 2018

(30) Foreign Application Priority Data

Sep. 12, 2016 (CN) ..... 2016 1 0816826

(51) Int. Cl.

| | |
|---|---|
| ***H01R 12/00*** | (2006.01) |
| ***H01R 13/52*** | (2006.01) |
| ***H01R 13/04*** | (2006.01) |
| ***H01R 12/72*** | (2011.01) |

(52) U.S. Cl.

CPC ..... *H01R 13/52* (2013.01); *H01R 12/721* (2013.01); *H01R 13/04* (2013.01); *H01R 2201/06* (2013.01)

(58) Field of Classification Search

CPC ..... H01R 12/7076; H01R 13/5025; H01R 13/629; H01R 13/62; H01R 13/7175; H01R 12/7005; H01R 13/64

USPC ..... 439/630, 629, 152, 327, 607.54, 607.1, 439/159, 681, 637

See application file for complete search history.

(56) References Cited

U.S. PATENT DOCUMENTS

| | | | | | |
|---|---|---|---|---|---|
| 5,478,259 | A * | 12/1995 | Noschese | H01R 23/6873 | 439/108 |
| 5,688,147 | A * | 11/1997 | Coteus | H01R 12/7005 | 439/633 |
| 5,842,880 | A * | 12/1998 | Pei | H01R 12/7005 | 439/327 |
| 5,957,708 | A * | 9/1999 | Lin | H01R 12/7005 | 439/157 |
| 6,093,046 | A * | 7/2000 | Chiou | H01R 12/7005 | 439/378 |

(Continued)

FOREIGN PATENT DOCUMENTS

CN 201549656 U 8/2010

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

A card edge connector includes an insulative elongated housing and a plurality of contacts disposed in the housing. The housing includes a pair of side walls extending along a longitudinal direction with a central slot therebetween in a transverse direction perpendicular to the longitudinal direction. Each side wall includes a plurality of passageways to receive the corresponding contacts, respectively. Each contact has the retaining section, a contacting section extending from one side of the retaining section, and a tail section extending from the other side of the retaining section. Each contact at a lower position is associated with a corresponding wiping terminal at an upper position in the same passageway.

20 Claims, 10 Drawing Sheets

(56) References Cited

U.S. PATENT DOCUMENTS 6,322,388 B1 * 11/2001 Akio ..... H01R 13/5812 439/459
6,663,402 B1 * 12/2003 Yu ..... H01R 13/65802 439/108
6,672,887 B1 * 1/2004 Yu ..... H01R 13/65802 439/108
6,695,630 B1 * 2/2004 Ku ..... H05K 7/1431 439/152
6,821,149 B2 * 11/2004 Lai ..... H01R 23/6873 439/607.31
7,108,554 B2 * 9/2006 Huang ..... H01R 23/6873 439/378
7,207,815 B1 * 4/2007 Ju ..... H01R 12/7029 439/159
7,442,093 B2 * 10/2008 Li ..... H01R 12/721 439/633
7,491,092 B2 * 2/2009 Zhu ..... H01R 13/6456 439/633
7,771,232 B2 * 8/2010 Si ..... H01R 12/716 439/607.01
8,038,459 B2 * 10/2011 Hayauchi ..... H01R 13/5213 439/301
8,092,239 B2 * 1/2012 Nishiyama ..... H01R 12/7005 439/157
8,794,988 B2 * 8/2014 Tanaka ..... H01R 12/83 439/326
2005/0277334 A1 * 12/2005 Huang ..... H01R 23/6873 439/607.01
2007/0254526 A1 * 11/2007 Lai ..... H05K 1/18 439/637
2010/0323549 A1 * 12/2010 Hayauchi ..... H01R 13/5213 439/357
2012/0135618 A1 * 5/2012 Shen ..... H01R 12/721 439/152
2013/0084723 A1 * 4/2013 Shen ..... H01R 12/7029 439/159
2013/0095679 A1 * 4/2013 Li ..... H01R 12/7005 439/157
2015/0318627 A1 * 11/2015 Berry, Jr. ..... H01R 12/7076 714/6.32
2016/0020539 A1 * 1/2016 Li ..... H01R 12/707 439/155
2016/0020540 A1 * 1/2016 Shen ..... G06F 1/203 439/155

* cited by examiner

CARD EDGE CONNECTOR HAVING WIPING DUMMY CONTACT

BACKGROUND OF THE DISCLOSURE

1. Field of the Disclosure

The invention is a card edge connector, and particularly to the electrical connector having the corresponding contact associated with a wiping dummy contact above.

2. Description of Related Arts

China Patent No. CN201549656U discloses a card edge connector having the contact with aligned dual contacting points. U.S. Pat. No. 7,637,783 discloses a card edge connector having the contact with aligned dual contacting beams. Anyhow, it is expected to provide the wiping action upon the corresponding conductive pad of the memory card during mating. In the aforementioned both designs, the upper contacting point is derived from the corresponding contacting beams extending from the tail of the contact, thus tending to be relatively too resilient and failing to perform the desired wiping action.

A card edge connector having the contacts associated with the corresponding mechanism to provide the expected wiping action, is desired

SUMMARY OF THE DISCLOSURE

A card edge connector includes an insulative elongated housing and a plurality of contacts disposed in the housing. The housing includes a pair of side walls extending along a longitudinal direction with a central slot therebetween in a transverse direction perpendicular to the longitudinal direction. Each side wall includes a plurality of passageways to receive the corresponding contacts, respectively. Each contact has the retaining section, a contacting section extending from one side of the retaining section, and a tail section extending from the other side of the retaining section. Each contact is associated with a corresponding wiping terminal in the same passageway wherein the wiping action is located above the contact and the contacting point of the contact is aligned with that of the wiping terminal in the vertical direction perpendicular to both the longitudinal direction and the transverse direction. The wiping terminal is downwardly assembled into the corresponding passageway and includes a body shorter than that of the contact for performing the expected wiping effect upon the corresponding conductive pad of the memory module which is inserted into the central slot.

DETAILED DESCRIPTION OF THE PREFERRED EMBODIMENT

Figure 1:
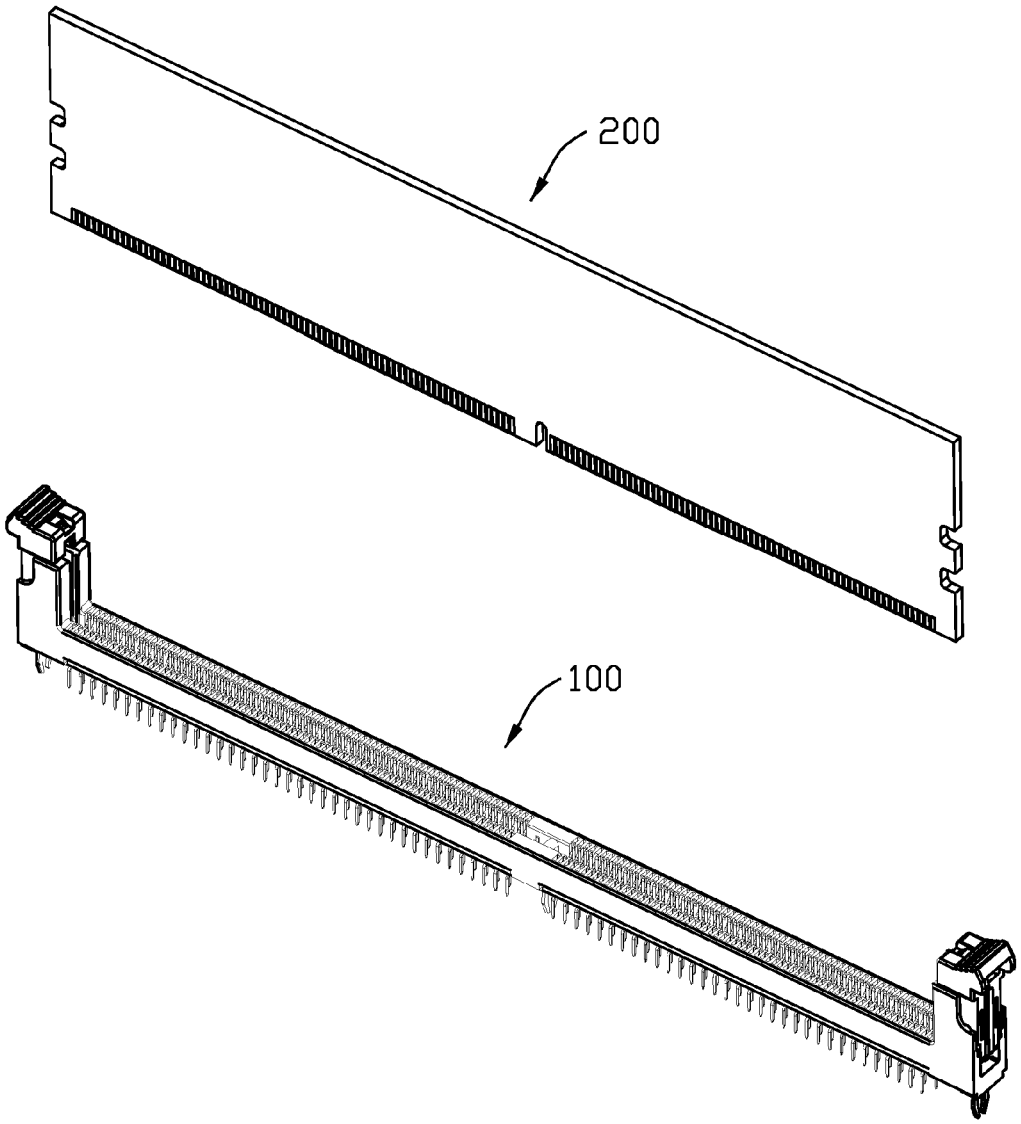
FIG. 1 is a perspective view of an electrical card edge connector with a corresponding memory module according to the invention.
Figure 2:
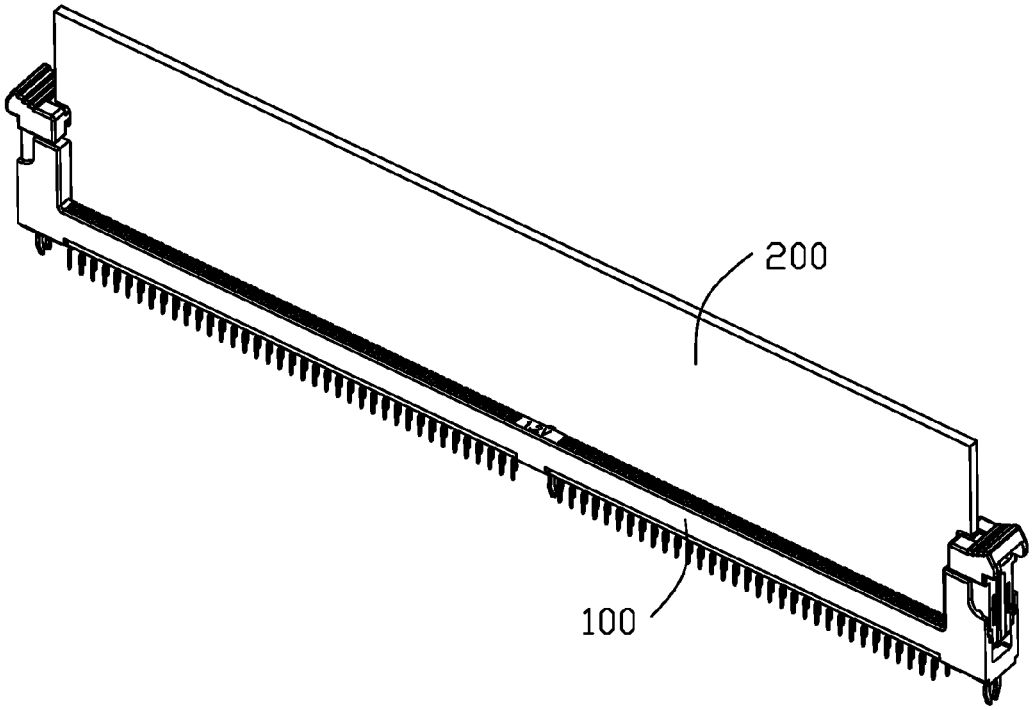
FIG. 2 is a perspective view of the electrical card edge connector of FIG. 1 with the memory module inserted thereinto.
Figure 3:
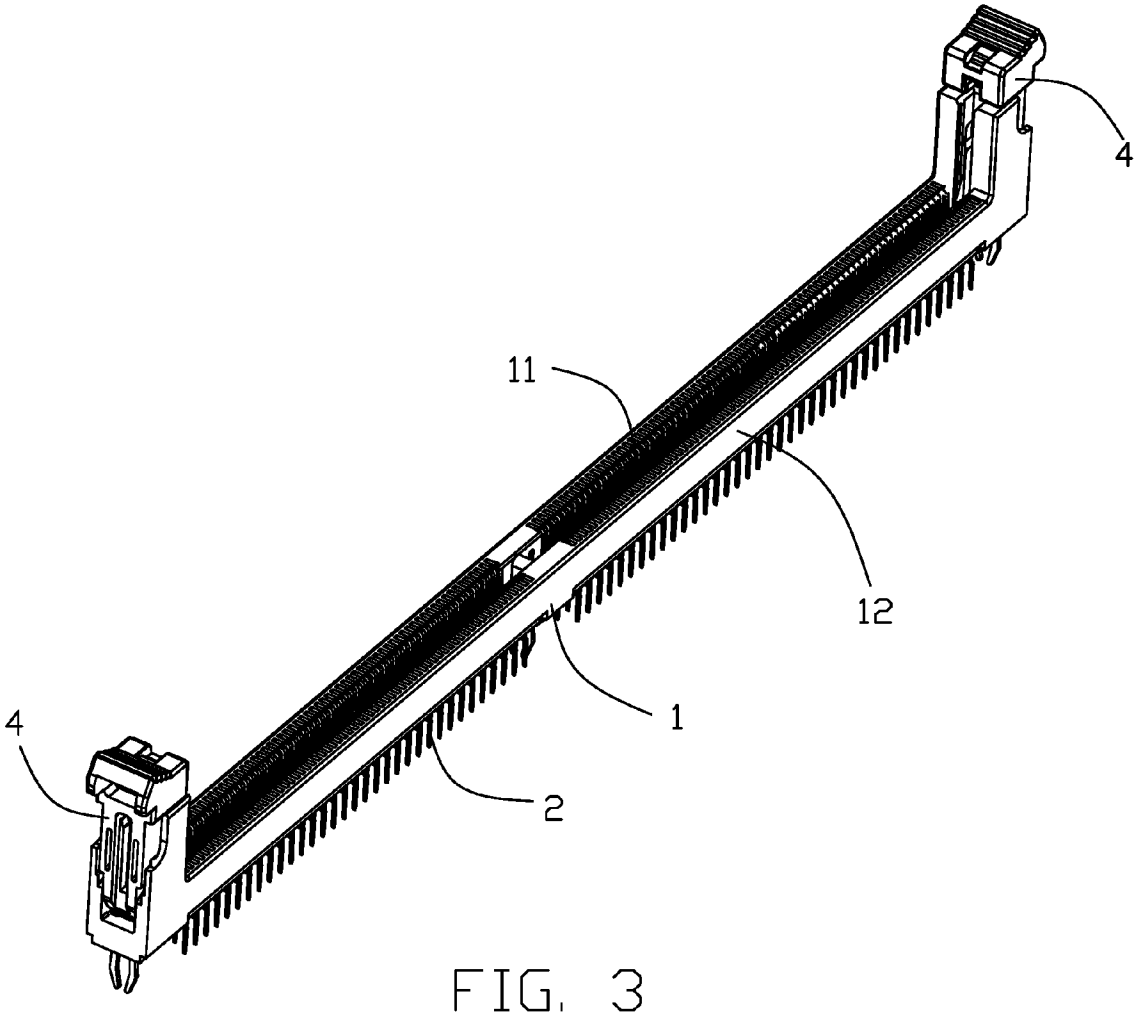
FIG. 3 is a perspective view of the electrical card edge connector of FIG. 1.
Figure 4:
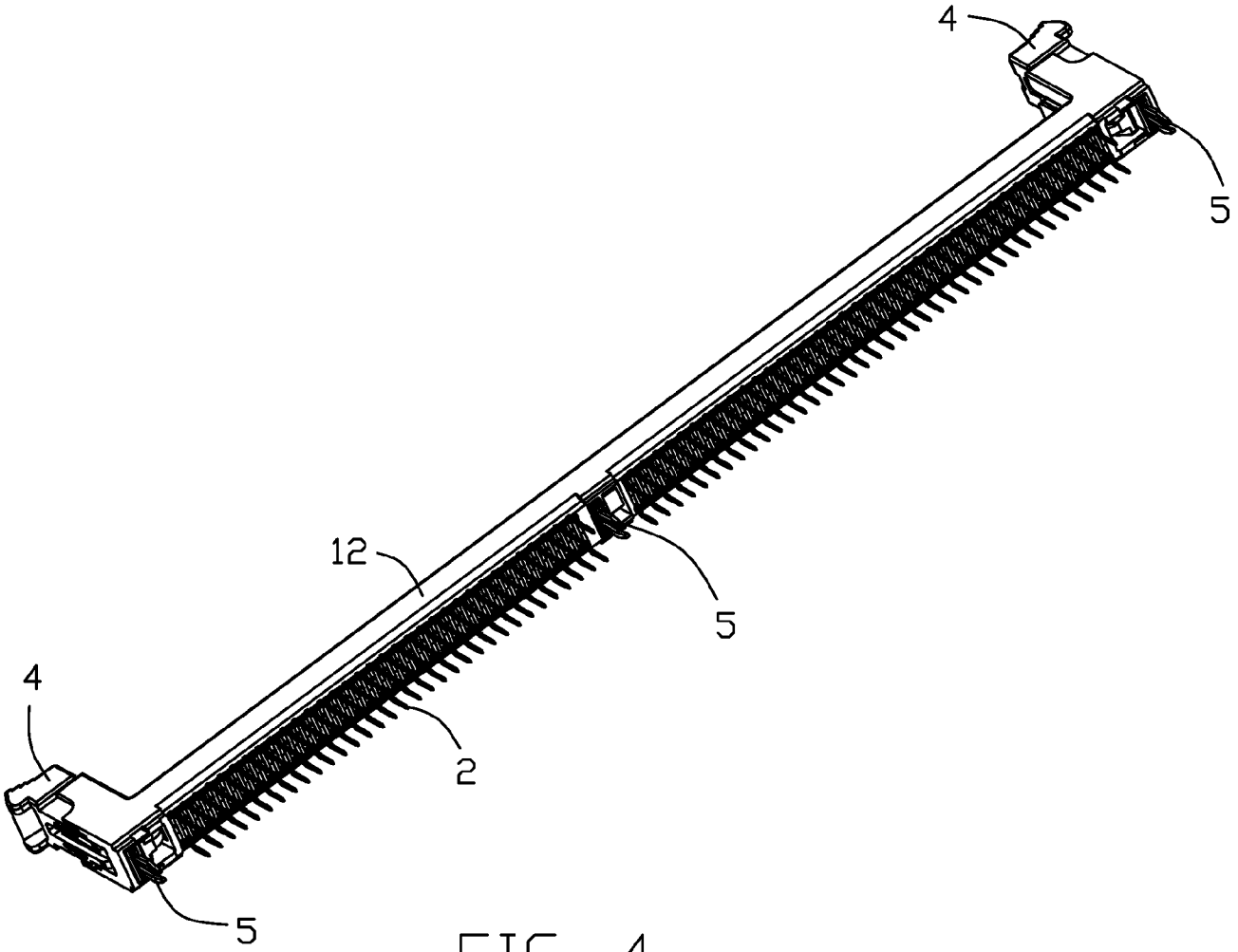
FIG. 4 is another perspective view of the electrical card edge connector of FIG. 3.
Figure 5:
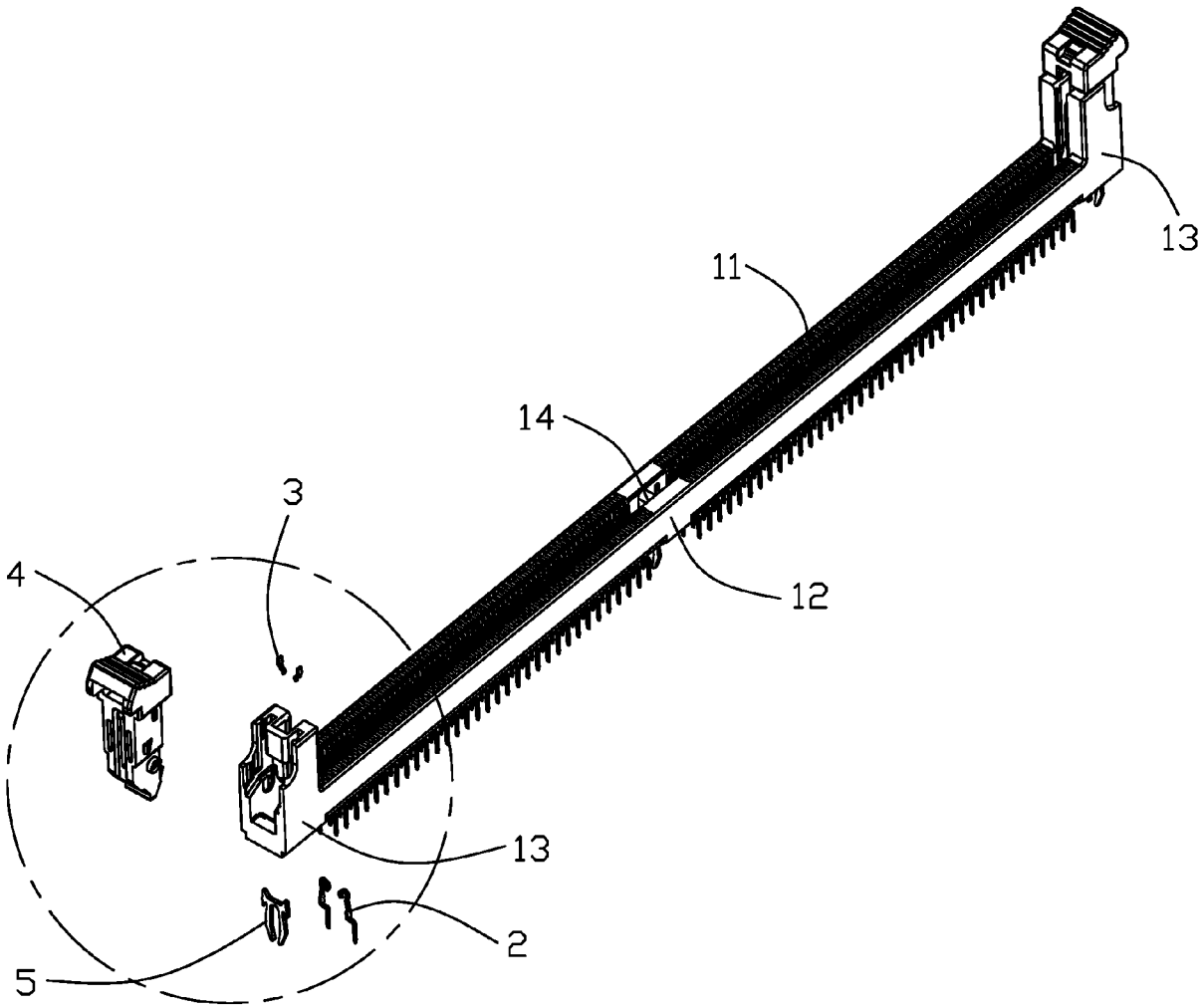
FIG. 5 is a partially exploded perspective view of the electrical card edge connector of FIG. 4.
Figure 6:
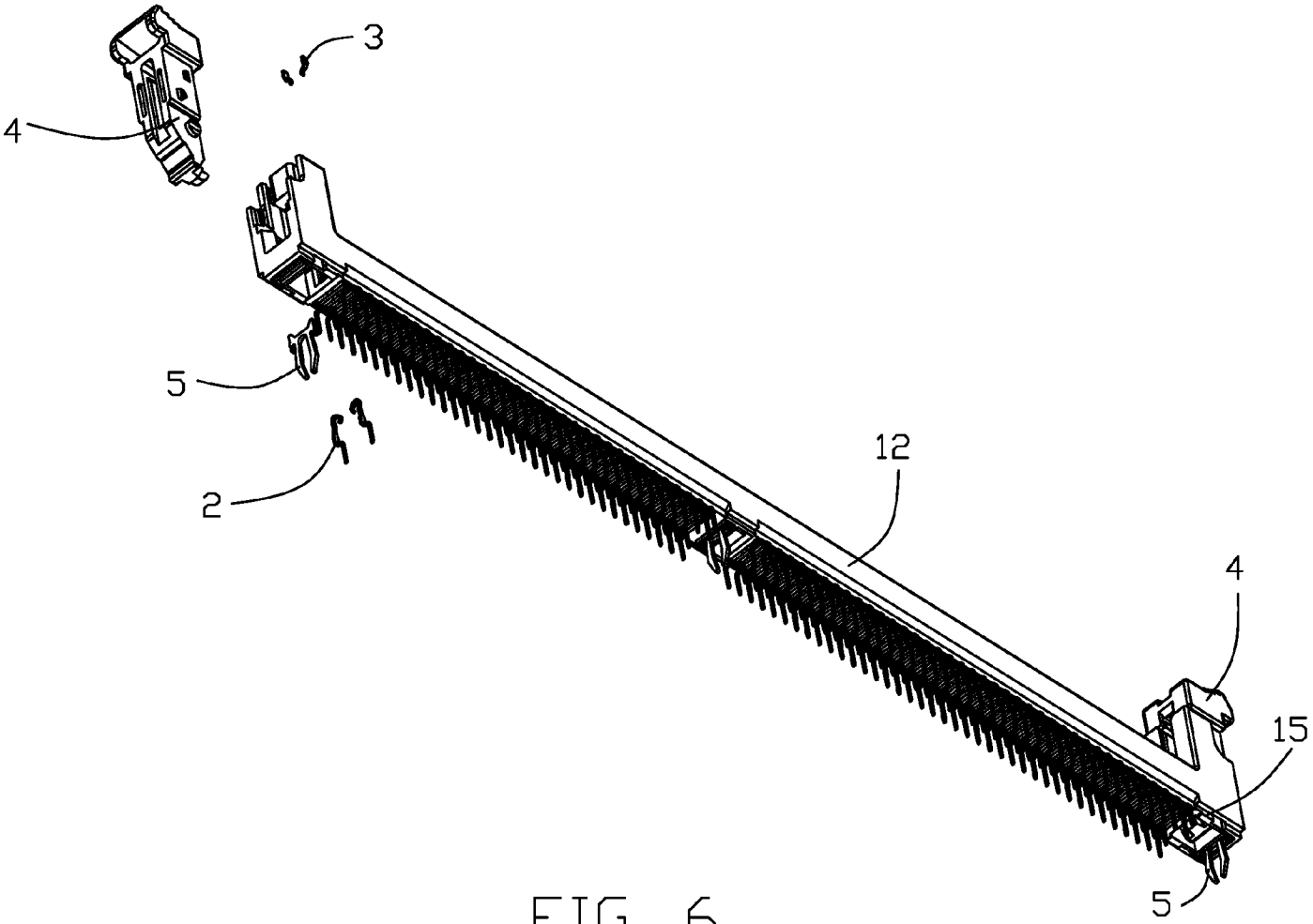
FIG. 6 is another partially exploded perspective view of the electrical card edge connector of FIG. 5.
Figure 7:
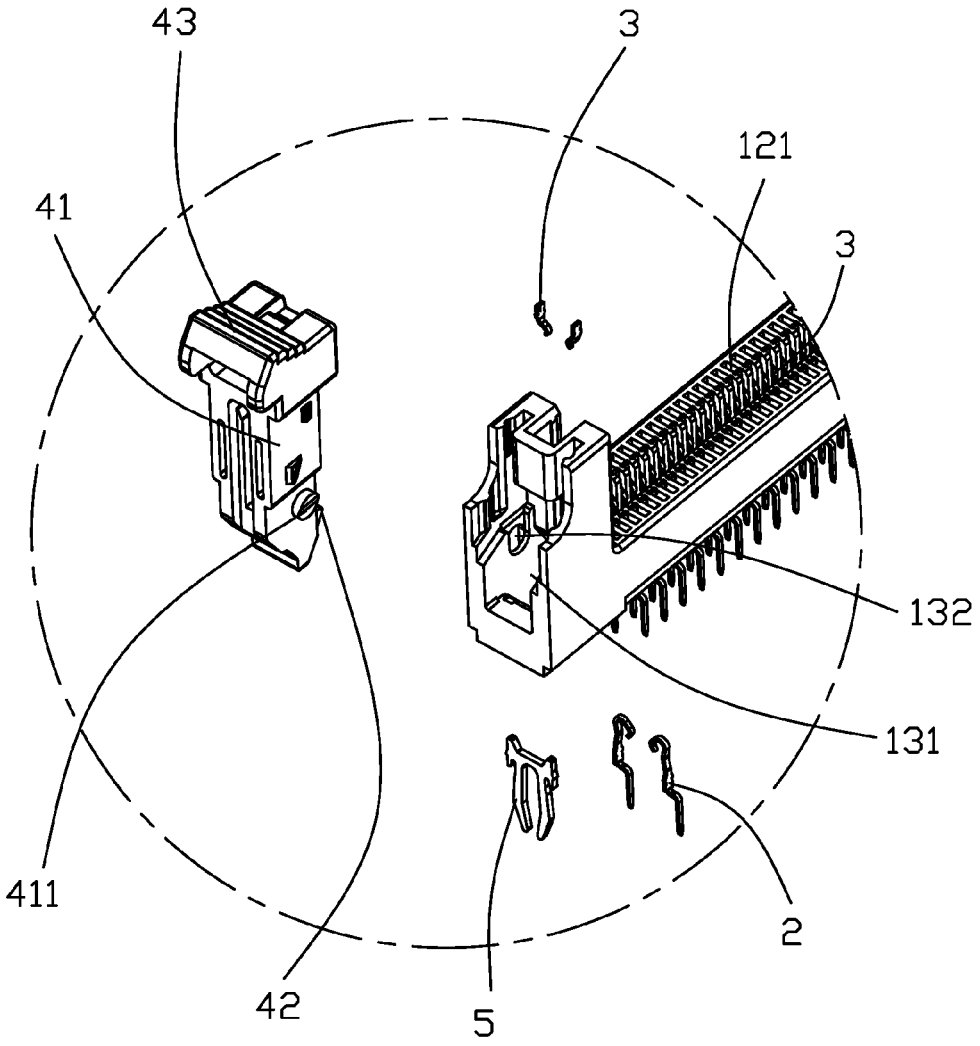
FIG. 7 is an enlarged partial perspective view of the electrical card edge connector of FIG. 5.
Figure 8:
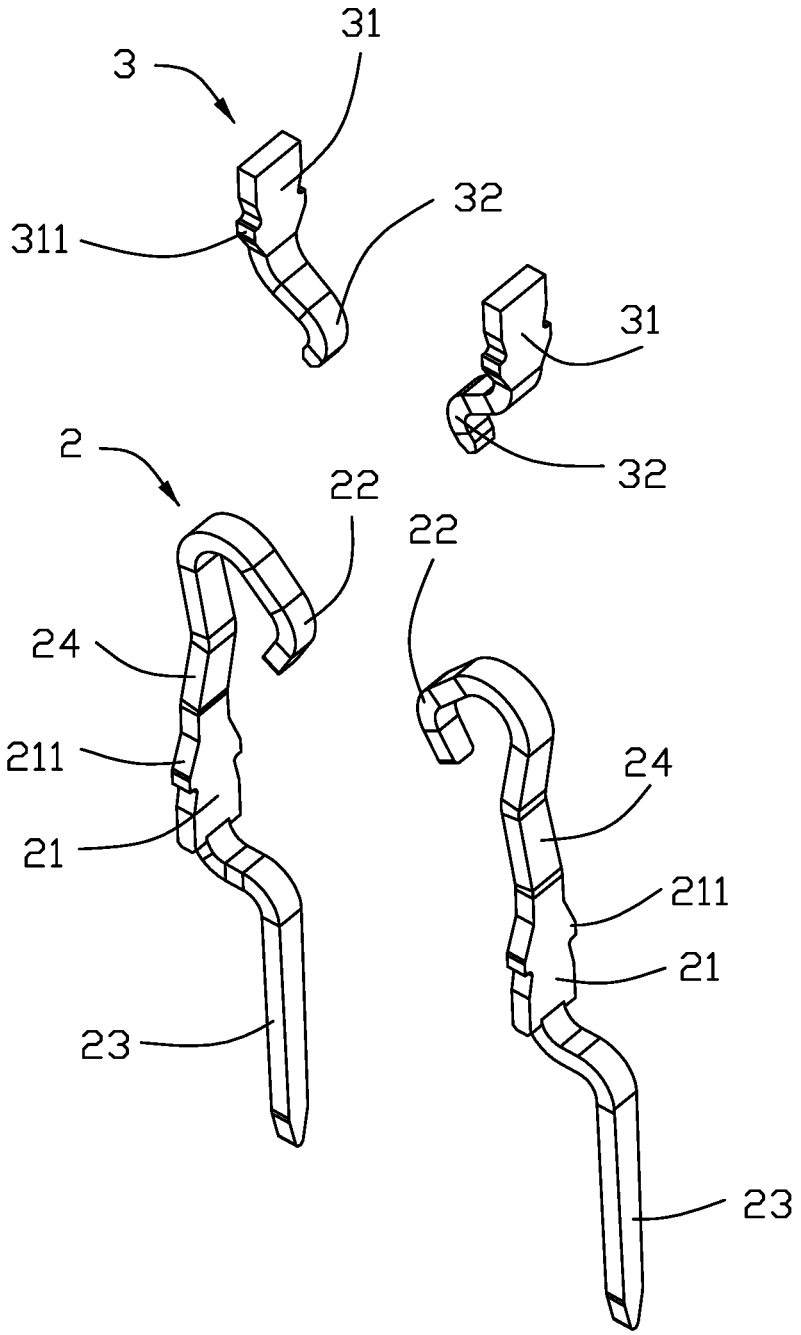
FIG. 8 is an enlarged perspective view of the contact of the electrical card edge connector of FIG. 7.
Figure 9:
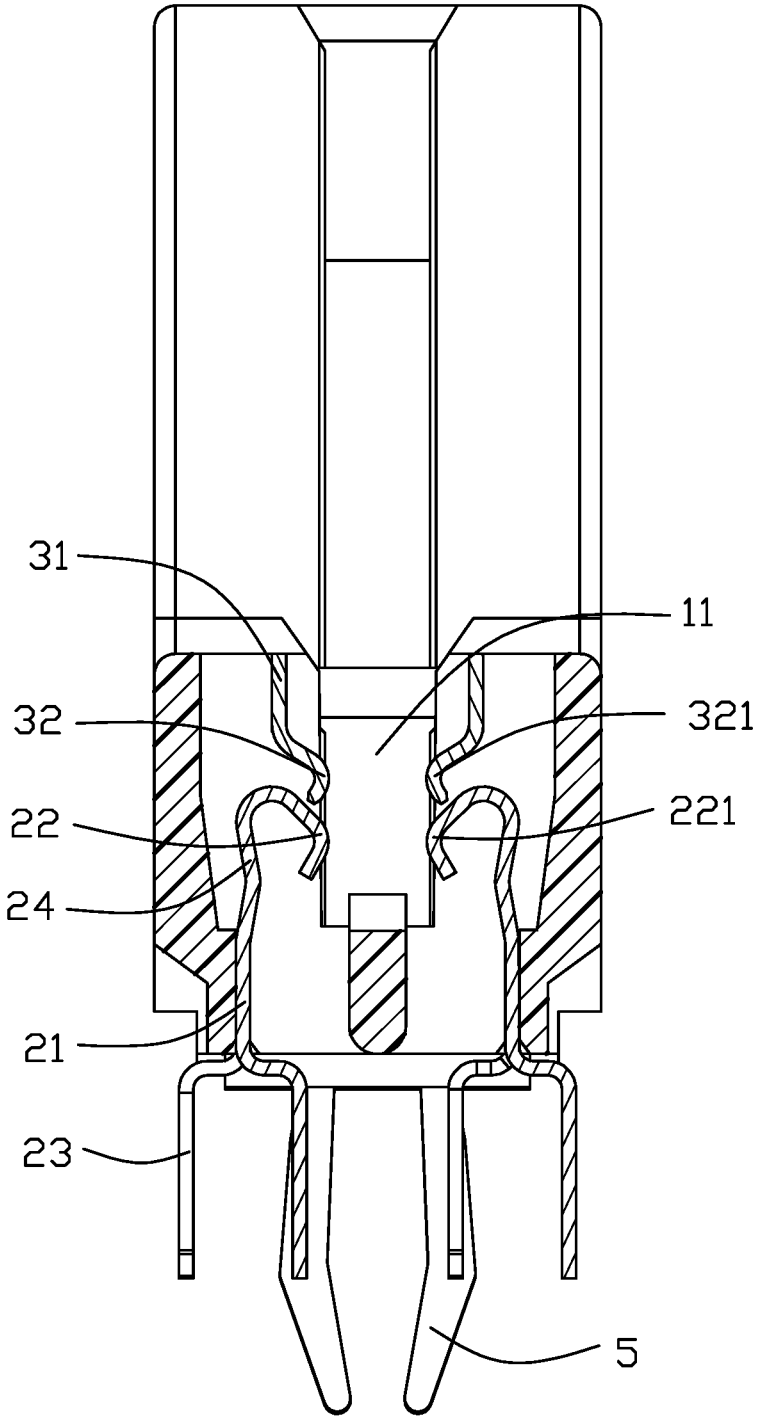
FIG. 9 is a cross-sectional view of the electrical card edge connector of FIG. 3.
Figure 10:
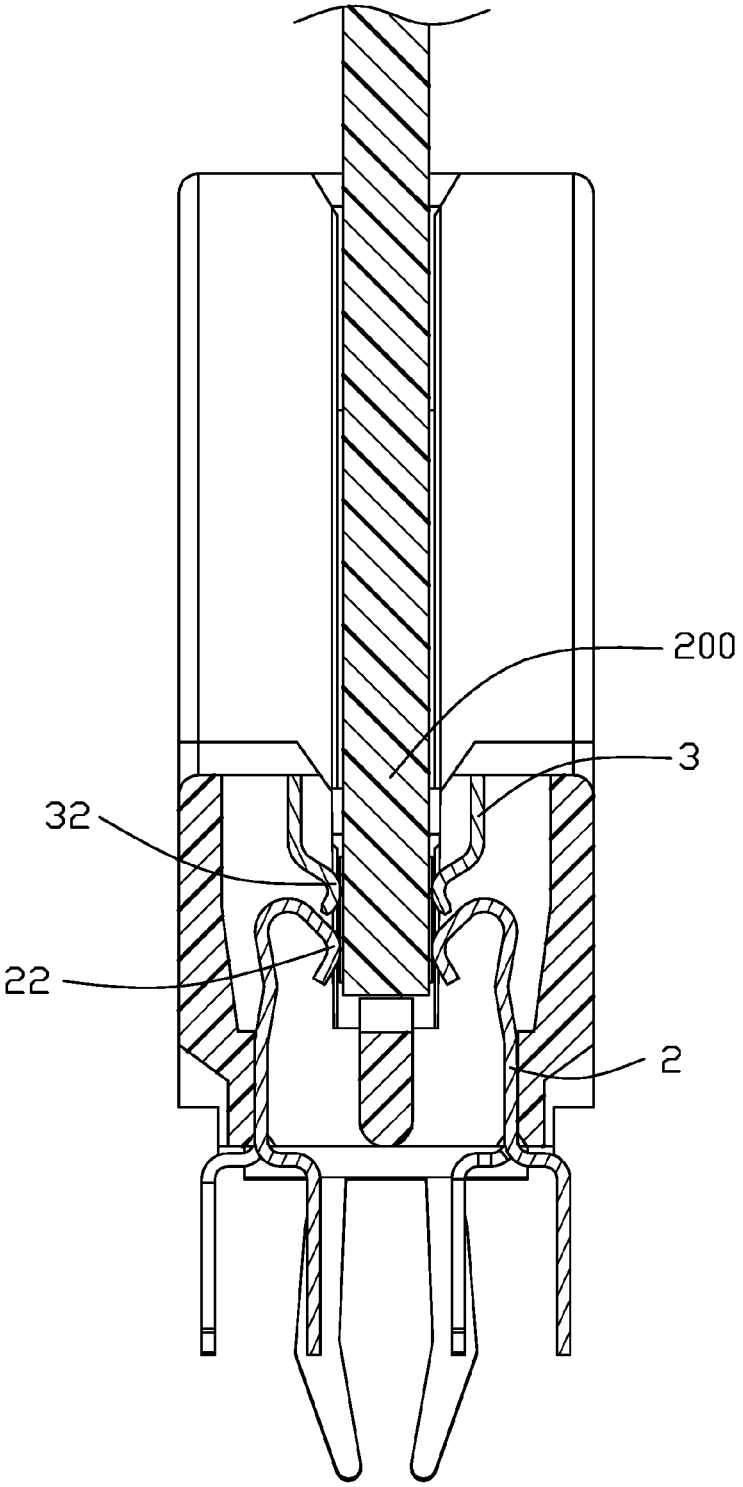
FIG. 10 is a cross-sectional view of the electrical card edge connector of FIG. 1 with the memory module inserted therein.

Referring to FIGS. 1-10, an electrical card edge connector 100 includes an elongated insulative housing 1, a plurality of contacts 2, a plurality of wiping terminals or dummy contacts 3 respectively associated with the corresponding contacts, the ejectors 4 and the board locks 5.

The housing 1 includes a pair of side walls 12 extending along the longitudinal direction with a central slot 11 therebetween in the transverse direction perpendicular to the longitudinal direction, and a pair of towers 13 located by two ends of the housing 1. A key 14 is located in the central slot 11 to divide the central slot 11 into two different segments. A plurality of passageways 121 extend through each of the side walls 12 in a vertical direction perpendicular to both the longitudinal direction and the transverse direction. Each contact 2 includes a retaining section 21, a contacting section 22 extending form one side of the retaining section 21 and into the central slot 11, and a tail/mounting section 23 extending from the other side of the retaining section 21 and exposed outside of the housing 1. The retaining section 21 forms barbs 211 on two sides for engagement with the side wall 12. An extension section 24 is located between the contacting section 22 and the retaining section 21. The mounting sections 23 are arranged with four rows totally. Similarly, the terminal 3 includes a retaining portion 31 and a wiping portion 32 extending from the retaining portion 31 and into the central slot 11 wherein the mounting section 23 forms barbs 311 on two sides for engagement with the side wall 12. Notably, each terminal 3 is not equipped with the tail/mounting portion for connecting to the printed circuit board. In other words, different from the dual function of the dual contacting points during operation in the aforementioned traditional connector, the invention is to provide only one contacting point during operation. Understandably, in the instant invention the additional contacting point is only for wiping the corresponding conductive pad during mating rather than electrical connection with conductive pad during operation with the inserted memory module.

Each passageway 121 receives one contact 2 and one corresponding wiping terminal 3 wherein the wiping terminal 3 is downwardly inserted into the passageway 121 while the contact 2 is upwardly inserted into the passageway 121. The terminal 3 occupies upper one third of the height of the corresponding passageway 121 while the contacts occupies lower two thirds of the height of the corresponding passageway 121. Notably, the contacting point 321 of the terminal 3 is aligned with and located above the contacting point 221 of the contacting section 22 of the contact 2 so as to efficiently wipe the corresponding conductive pad before such a conductive pad is mechanically and electrically connected to the corresponding contacting section 22 of the contact 2 for superior connection therebetween. The contacting section 22 is of the upside-down bellow type while the wiping portion 32 is of the downward cantilevered type. In this embodiment, the retaining section 21 of the contact 2 essentially abuts against and intimately located upon an interior surface of the corresponding passageway 121 in the transverse direction while the retaining portion 31 of the terminal 3 is essentially and intentionally offset from the retaining section 121 of the corresponding contact 2 in the transverse direction for avoiding jeopardizing the structure of the same passageway 121 in the corresponding side wall 12 due to interference occurring upon the same position in the vertical direction.

The tower 13 includes a receiving cavity 131 and the ejector 4 is received in the receiving cavity 131 for locking the memory module 200. The ejector 4 includes a main body 41, a kicker 42 located at the bottom portion of the main body 41, and a handler 43 located at the top portion of the main body 41. The tower 13 includes a pivot groove 132 to receive the pivot shaft 411 of the main body 41 whereby the ejector 4 is rotatable in the receiving cavity 131. The ejector 4 is rotated to a locking position by downward movement of the memory module 200 against the kicker 42, and is rotated to a unlocking position by sidewardly pressing the handler 43 to eject the memory module 200. The board lock 5 attached to an underside of the housing 1 for mounting the connector 100 upon the printed circuit board.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector for receiving a memory module therein, comprising:

an elongated insulative housing having a pair of side walls extending along a longitudinal direction with a central slot therebetween in a transverse direction perpendicular to said longitudinal direction;

a plurality of passageways extending through each of said side walls in a vertical direction perpendicular to both said longitudinal direction and said transverse direction;

each of said passageways being equipped with a contact and a wiping terminal discrete from each other wherein the contact has a retaining section, a contacting section extending from one side of the retaining section and into the central slot, and a mounting section extending from the other side of the retaining section and out of the housing for mounting to a printed circuit board, and the terminal is located above the contact and has a retaining portion and a wiping portion extending from one side of the retaining portion and into the central slot; wherein said terminal has no means for mounting to the printed circuit board.

2. The electrical connector as claimed in claim 1, wherein the wiping portion forms an upper contacting point while the contacting section forms a lower contacting point aligned with and located under the upper contacting point in the vertical direction.

3. The electrical connector as claimed in claim 1, wherein in each of said passageways, the retaining section of the corresponding contact and the retaining portion of the corresponding terminal is not aligned with each other in the vertical direction but being offset from each other in the transverse direction.

4. The electrical connector as claimed in claim 3, wherein the retention section of the corresponding contact abuts against an interior surface of the corresponding side wall while the retention portion of the corresponding is located between the central slot and the corresponding side wall.

5. The electrical connector as claimed in claim 1, wherein said contacts are configured to be upwardly assembled into the corresponding passageways while said terminals are configured to be downwardly assembled into the corresponding passageways.

6. The electrical connector as claimed in claim 1, wherein the terminal occupies upper one third of a height of the corresponding passageway while the contact occupies lower two thirds of the height of the corresponding passageway in the vertical direction.

7. The electrical connector as claimed in claim 1, wherein the wiping portion is of a downward cantilevered type while the contacting section is of an upside-down bellow type.

8. An electrical connector for receiving a memory module therein, comprising:

an elongated insulative housing having a pair of side walls extending along a longitudinal direction with a central slot therebetween in a transverse direction perpendicular to said longitudinal direction;

a plurality of passageways extending through each of said side walls in a vertical direction perpendicular to both said longitudinal direction and said transverse direction;

each of said passageways being equipped with a contact and a wiping terminal discrete from each other wherein the contact has a retaining section, a contacting section extending from one side of the retaining section and into the central slot, and a mounting section extending from the other side of the retaining section and out of the housing for mounting to a printed circuit board, and the terminal is located above the contact and has a retaining portion and a wiping portion extending from one side of the retaining portion and into the central slot; wherein in each of said passageways, the corresponding terminal is shorter than the contact in the vertical direction.

9. The electrical connector as claimed in claim 8, wherein the wiping portion forms an upper contacting point while the contacting section forms a lower contacting point aligned with and located under the upper contacting point in the vertical direction.

10. The electrical connector as claimed in claim 8, wherein in each of said passageways, the retaining section of the corresponding contact and the retaining portion of the corresponding terminal is not aligned with each other in the vertical direction but being offset from each other in the transverse direction.

11. The electrical connector as claimed in claim 10, wherein the retention section of the corresponding contact abuts against an interior surface of the corresponding side wall while the retention portion of the corresponding is located between the central slot and the corresponding side wall.

12. The electrical connector as claimed in claim 8, wherein said contacts are configured to be upwardly assembled into the corresponding passageways while said terminals are configured to be downwardly assembled into the corresponding passageways.

13. The electrical connector as claimed in claim 8, wherein the terminal occupies upper one third of a height of the corresponding passageway while the contact occupies lower two thirds of the height of the corresponding passageway in the vertical direction.

14. The electrical connector as claimed in claim 8, wherein the wiping portion is of a downward cantilevered type while the contacting section is of an upside-down bellow type.

15. An electrical connector for receiving a memory module therein, comprising:

an elongated insulative housing having a pair of side walls extending along a longitudinal direction with a central slot therebetween in a transverse direction perpendicular to said longitudinal direction;

a plurality of passageways extending through each of said side walls in a vertical direction perpendicular to both said longitudinal direction and said transverse direction;

each of said passageways being equipped with a contact and a wiping terminal discrete from each other wherein the contact has a retaining section, a contacting section extending from one side of the retaining section and into the central slot, and a mounting section extending from the other side of the retaining section and out of the housing for mounting to a printed circuit board, and the terminal is located above the contact and has a retaining portion and a wiping portion extending from one side of the retaining portion and into the central slot; wherein the wiping portion forms an upper contacting point while the contacting section forms a lower contacting point aligned with and located under the upper contacting point in the vertical direction.

16. The electrical connector as claimed in claim 15, wherein in each of said passageways, the retaining section of the corresponding contact and the retaining portion of the corresponding terminal is not aligned with each other in the vertical direction but being offset from each other in the transverse direction.

17. The electrical connector as claimed in claim 16, wherein the retention section of the corresponding contact abuts against an interior surface of the corresponding side wall while the retention portion of the corresponding is located between the central slot and the corresponding side wall.

18. The electrical connector as claimed in claim 15, wherein said contacts are configured to be upwardly assembled into the corresponding passageways while said terminals are configured to be downwardly assembled into the corresponding passageways.

19. The electrical connector as claimed in claim 15, wherein the terminal occupies upper one third of a height of the corresponding passageway while the contact occupies lower two thirds of the height of the corresponding passageway in the vertical direction.

20. The electrical connector as claimed in claim 15, wherein the wiping portion is of a downward cantilevered type while the contacting section is of an upside-down bellow type.

* * * * *